US010408562B2

(12) United States Patent
Liao

(10) Patent No.: US 10,408,562 B2
(45) Date of Patent: Sep. 10, 2019

(54) GAS HEATING STRUCTURE OF BULLET MAGAZINE

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 0 days.

(21) Appl. No.: 15/989,138

(22) Filed: May 24, 2018

(65) Prior Publication Data

US 2019/0025010 A1 Jan. 24, 2019

(30) Foreign Application Priority Data

Jul. 21, 2017 (TW) ..... 106210779 U

(51) Int. Cl.

| | |
|---|---|
| ***F41B 11/50*** | (2013.01) |
| ***F41B 11/56*** | (2013.01) |
| ***F41B 11/71*** | (2013.01) |
| ***F41B 11/62*** | (2013.01) |

(52) U.S. Cl.

CPC ..... *F41B 11/56* (2013.01); *F41B 11/50* (2013.01); *F41B 11/62* (2013.01); *F41B 11/71* (2013.01)

(58) Field of Classification Search

CPC F41B 11/00; F41B 11/50; F41B 11/56; F41B 11/57

USPC ..... 124/45, 51.1

See application file for complete search history.

(56) References Cited

U.S. PATENT DOCUMENTS

| | | | | | |
|---|---|---|---|---|---|
| 4,083,349 | A * | 4/1978 | Clifford | F41B 11/52 | 124/45 |
| 6,055,910 | A * | 5/2000 | Zanakis | F41A 1/04 | 102/347 |
| 6,444,086 | B1 * | 9/2002 | Andler | C23C 14/022 | 156/345.31 |
| 7,093,591 | B1 * | 8/2006 | Baxter | F41B 11/52 | 124/49 |
| 7,337,774 | B2 * | 3/2008 | Webb | F41B 11/57 | 124/60 |
| 7,353,815 | B2 * | 4/2008 | Wei | F41B 11/56 | 124/45 |
| 8,640,684 | B2 * | 2/2014 | Gur | F41B 11/71 | 124/77 |

(Continued)

*Primary Examiner* — Alexander R Niconovich
(74) *Attorney, Agent, or Firm* — Leong C. Lei

(57) ABSTRACT

A magazine gas heating structure includes a magazine body, an electricity supply device arranged in the magazine body, a heating assembly arranged in the magazine body and electrically connected with the electricity supply device, a liquid channel defined in the magazine body, and a turbulence thermal conduction element arranged in the magazine body and connected to the heating assembly. The turbulence thermal conduction element is arranged at an end of the liquid channel. As such, a user may set the magazine body into a toy gun to allow the electricity supply device to supply electrical energy to the heating assembly, so that the heating assembly heats the turbulence thermal conduction element. Pressurized fluid is conducted to pass through the turbulence thermal conduction element and efficiently absorb thermal energy from the turbulence thermal conduction element so that the pressurized fluid is converted into gas for firing the toy gun.

7 Claims, 5 Drawing Sheets

(56) References Cited

U.S. PATENT DOCUMENTS

| | | | | |
|---|---|---|---|---|
| 9,222,737 | B1 * | 12/2015 | Lund | F41A 1/04 |
| 2007/0256676 | A1 * | 11/2007 | Orvis | F41B 11/50 124/31 |

* cited by examiner

GAS HEATING STRUCTURE OF BULLET MAGAZINE

TECHNICAL FIELD OF THE INVENTION

The present invention relates generally to a gas heating structure of a bullet magazine, and more particularly to a magazine gas heating structure that enable heating to be directly conducted inside a magazine body to maintain the magazine body at an optimum environmental operation temperature for making gasification more complete to thereby improve and maintain the performance thereof.

DESCRIPTION OF THE PRIOR ART

Modern people are living in a very fast pace, which often accompanied with increased living stress. Various measures are taken for relaxing or relieving of such stress. One of such measures for stress relieving is survival games, in which players who are equipped with replica or reality-mimicking toy guns to combat each other in a simulative combat field in order to achieve the purpose of stress relieving. Shooting of such toy guns generally involves pressurized fluid or electric firing to project bullets or projectiles out of the toy guns. The pressurized fluid used is often pressurized gas or compressed carbon dioxide. Gasification of the pressurized fluid that occurs in a bullet magazine absorbs thermal energy from the surroundings. After multiple successive shots, the bullet magazine would get excessively cold so that the gasification of the pressurized gas becomes poor and bad, leading to inoperability of shooting of the toy gun. To overcome such an issues of the bullet magazine getting excessively cold, Taiwan Utility Model M542760 proposes a "handle temperature control device", of which the technical contents are generally "a handle and a temperature control device, wherein the handle defines therein a receiving space in which a magazine can be arranged and the temperature control device is arranged between the receiving space and an internal wall of the handle, characterized in that the temperature control device comprises a thermal isolation element, a heating element, a thermal conduction element, and a control module, wherein the thermal conduction element is arranged to face the receiving space, whereby in case that a gasification operation of a bullet magazine that contains therein pressurized gas is deteriorating due to a long term use of the toy gun, heating can be immediately carried out by the heating element driven by the control module such that thermal energy is generated and conducted through the thermal conduction element to the magazine." In this way, an environmental operation temperature of the bullet magazine is kept and gasification can be made more complete to thereby improve and maintain the performance thereof.

However, in the operation of the handle temperature control device, since heating of the magazine is made from the outside of the magazine. Thermal energy may get lost to the outside during the course of heating. This causes a waste of energy and also leads to an issue of poor heating performance.

SUMMARY OF THE INVENTION

The primary objective of the present invention is a unique arrangement of an electricity supply device and a heating element that allows heating to be directly conducted in an interior of a magazine body of a bullet magazine such that the magazine body is kept at an optimum environmental operation temperature to thereby heighten the performance of heating and achieving an effect of saving energy.

Another objective of the present invention is that a unique arrangement of a turbulence thermal conduction element that increases a surface area of contact between pressurized fluid and the turbulence thermal conduction element so that gasification of the pressurized fluid is made more efficiently and more completely.

A further objective of the present invention is that a unique arrangement of a terminal end of a liquid channel is provided in the turbulence thermal conduction element so that the heating efficiency of the turbulence thermal conduction element is made even higher.

To achieve the above objective, the present invention provides a structure that generally comprises a magazine body, which is provided therein with at least one electricity supply device. The magazine body is further provided therein with at least one heating assembly electrically connected with the electricity supply device. The magazine body defines at least one liquid channel therein. The magazine body is provided therein with at least one turbulence thermal conduction element connected to the heating assembly. The turbulence thermal conduction element is arranged at one end of the liquid channel. As such, a user may combine the magazine body with a toy gun so that the electricity supply device may supply electrical energy to the heating assembly. With the heating assembly heating the turbulence thermal conduction element, when pressurized fluid passes through the turbulence thermal conduction element to increase a contact surface area between the turbulence thermal conduction element and the pressurized fluid, the efficiency of gasification of the pressurized fluid can be improved so that the magazine is set at an optimum environmental operation temperature and the pressurized fluid is converted into gas before reaching the end of the liquid channel, whereby the heating efficiency of the turbulence thermal conduction element is made even higher and the use of energy is made more economic.

With the above techniques, the drawbacks of the prior art that a handle temperature control device is heated from outside the magazine, thermal energy may get lost to the outside during the course of heating, and energy may be wasted and heating efficiency is poor can be overcome and utilization of the present invention can be improved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
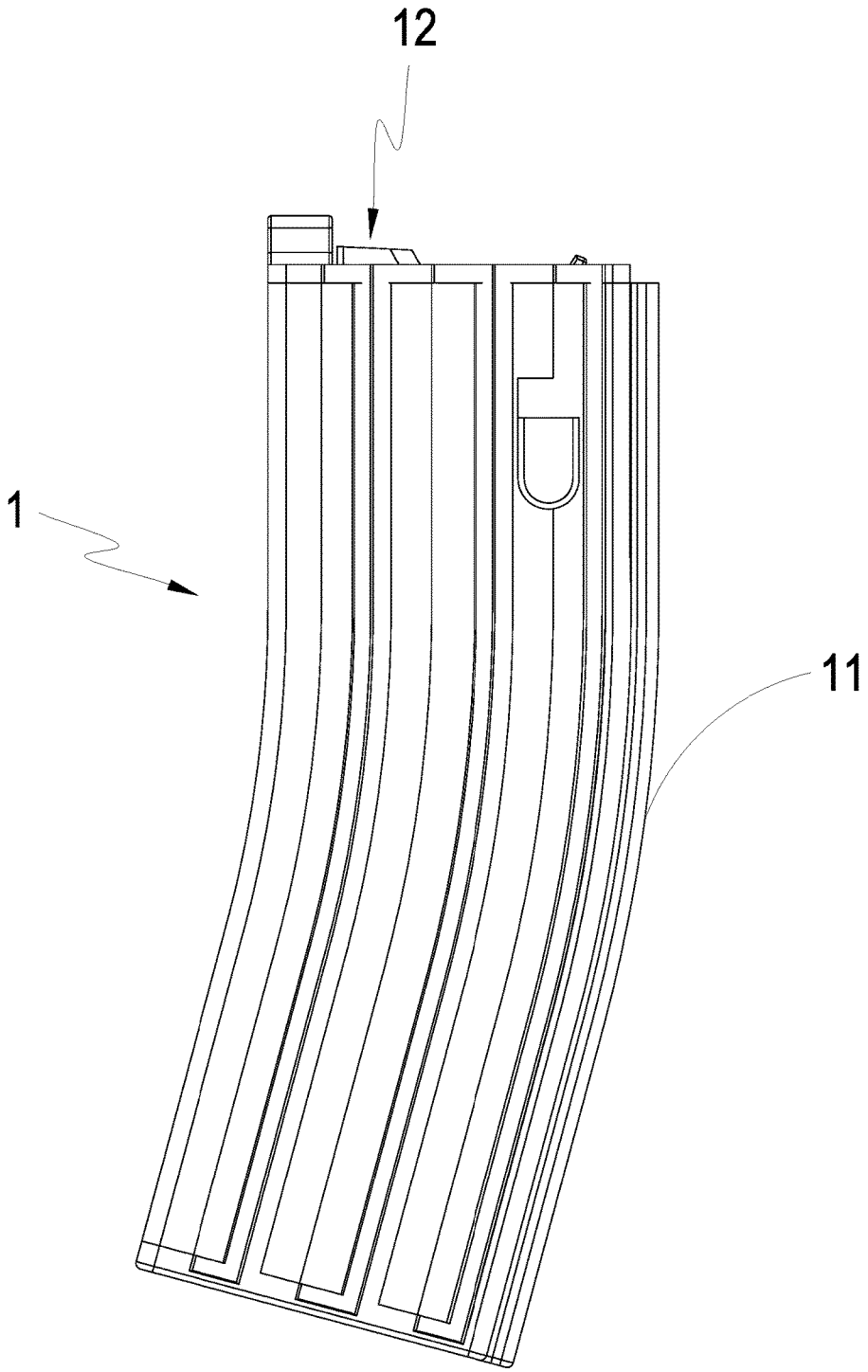
FIG. 1 is a front view showing a preferred embodiment of the present invention.
Figure 2:
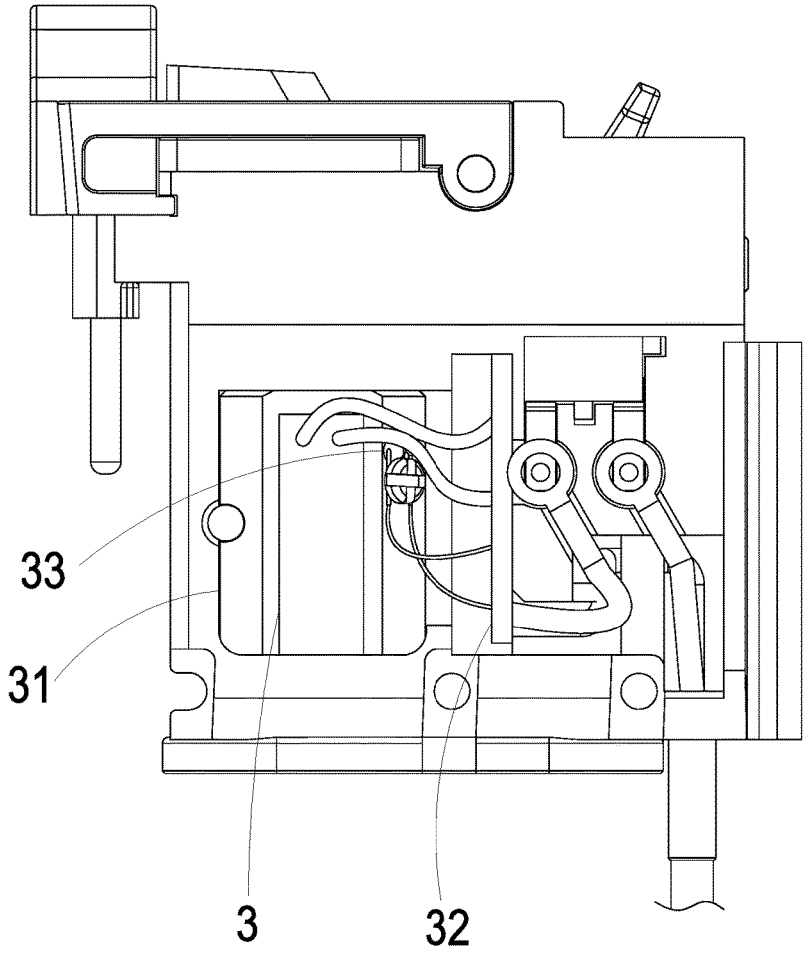
FIG. 2 is a schematic view showing a part of an interior structure of a magazine body of the preferred embodiment of the present invention.
Figure 3:
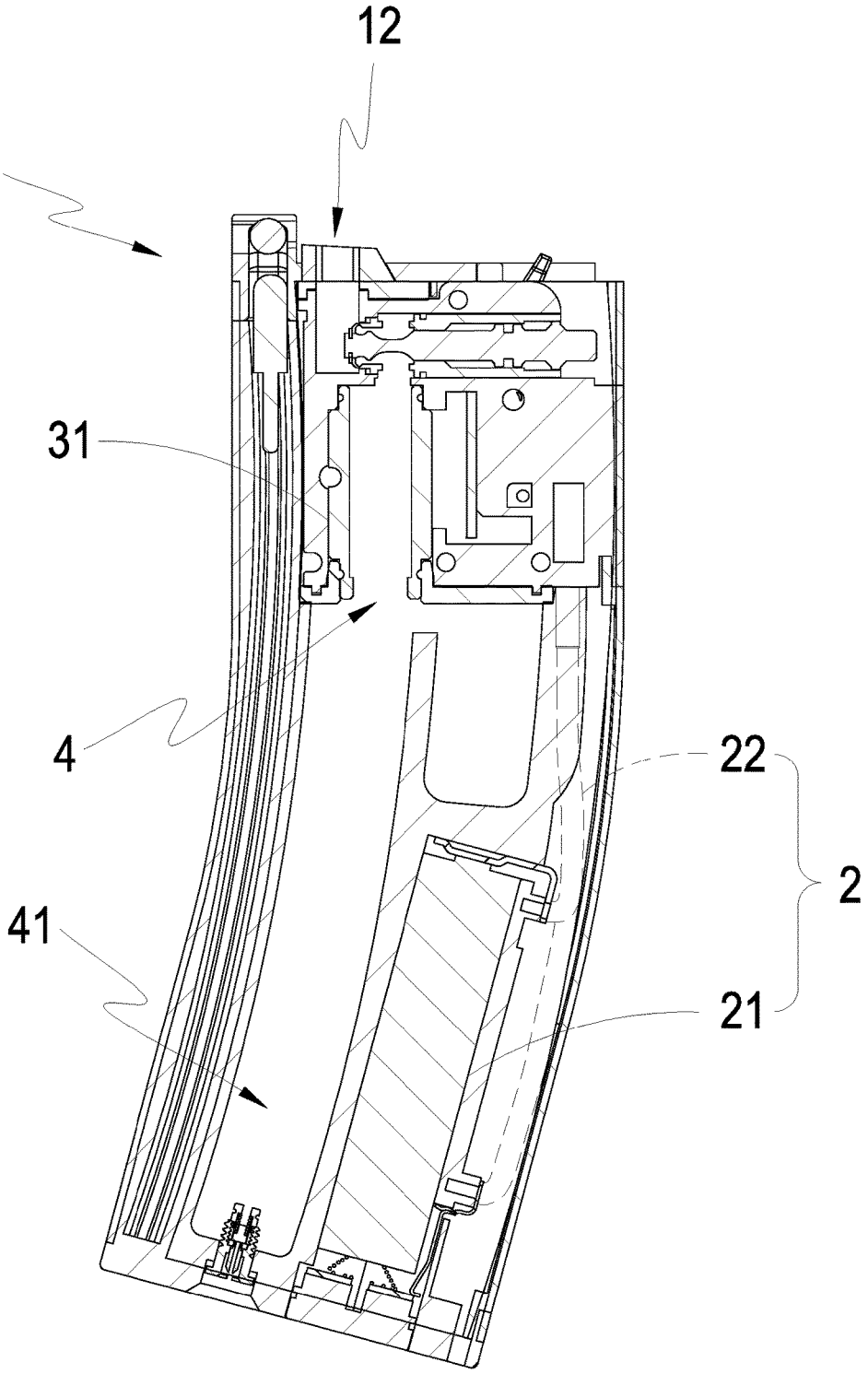
FIG. 3 is a cross-sectional view of the preferred embodiment of the present invention.
Figure 4:
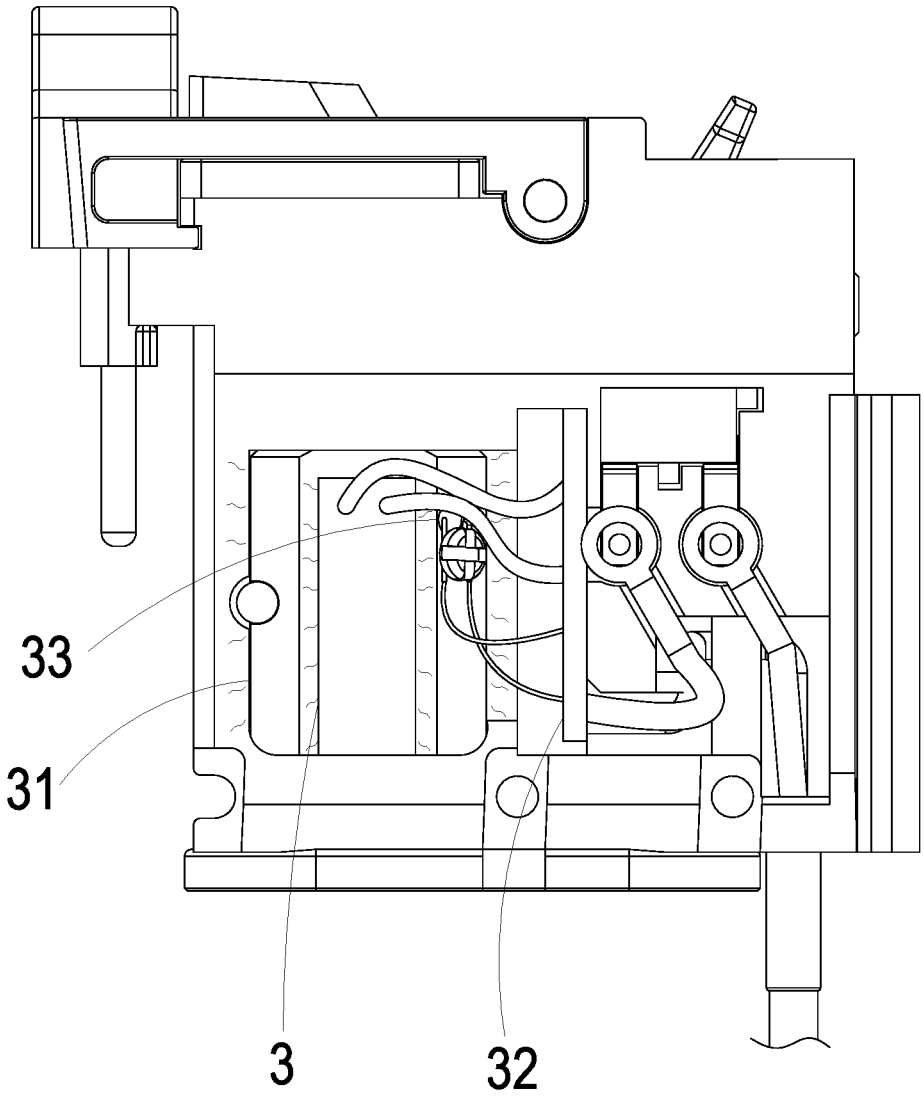
FIG. 4 is a schematic view illustrating an example of the preferred embodiment of the present invention.
Figure 5:
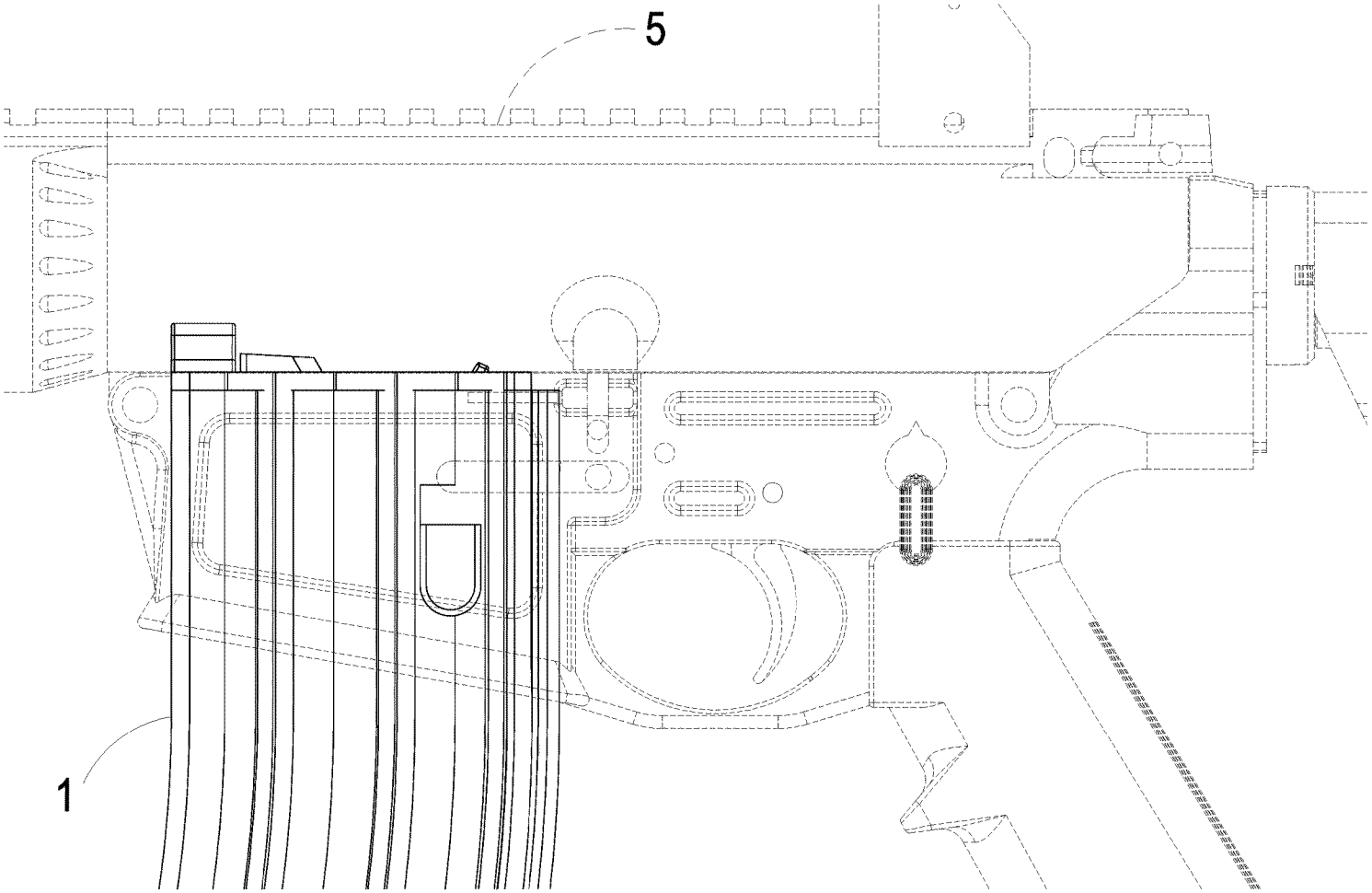
FIG. 5 is a schematic view demonstrating a use of the preferred embodiment of the present invention.

Referring to FIGS. 1-3, which are respectively a front view showing a preferred embodiment of the present invention, a schematic view showing a part of an interior structure of a magazine body of the preferred embodiment of the present invention, and a cross-sectional view of the preferred embodiment of the present invention, as shown in the drawings, the present invention comprises:

a magazine body 1, wherein the magazine body 1 defines at least one thermal isolation section 11, the thermal isolation section 11 is made of a plastic material, the magazine body 1 further defining at least one gas discharge section 12;

at least one electricity supply device 2 arranged in the magazine body 1, the electricity supply device 2 comprising at least one electricity supply element 21 and at least one electrical conduction element 22 electrically connected with the electricity supply element 21, the electrical conduction element 22 being electrically connected with a control assembly 32 that will be described hereinafter, the electricity supply element 21 comprising a battery or an electric cell;

at least one heating assembly 3 arranged in the magazine body 1 and electrically connected with the electricity supply device 2, the heating assembly 3 being provided with at least one control assembly 32, the magazine body 1 comprising at least one turbulence thermal conduction element 31 that is connected to the heating assembly 3, the turbulence thermal conduction element 31 being arranged at a terminal end of a liquid channel 4 that will be described hereinafter, the turbulence thermal conduction element 31 being provided with at least one temperature detection element 33 electrically connected with the control assembly 32; and at least one liquid channel 4 defined in the magazine body 1 and in communication with the turbulence thermal conduction element 31, the magazine body 1 defining therein at least one liquid storage space 41 in communication with the liquid channel 4.

Referring to FIGS. 1-5, which are respectively a front view showing a preferred embodiment of the present invention, a schematic view showing a part of an interior structure of a magazine body of the preferred embodiment of the present invention, a cross-sectional view of the preferred embodiment of the present invention, a schematic view illustrating an example of the preferred embodiment of the present invention, and a schematic view demonstrating a use of the preferred embodiment of the present invention, it can clearly see from the drawings that the magazine body 1 is mountable to a toy gun 5. The toy gun 5 can be a gas gun and the magazine body 1 comprises the liquid storage space 41 therein for storage of pressurized fluid. The pressurized fluid can be one of liquefied gas and liquefied carbon dioxide. The magazine body 1 comprises the electricity supply device 2 arranged therein and the electricity supply device 2 comprises the electricity supply element 21 and the electrical conduction element 22. The electricity supply element 21 comprises a battery or an electric cell. The electrical conduction element 22 comprises a metallic conductor such that electrical energy from the electricity supply element 21 is conducted through the electrical conduction element 22 to the control assembly 32. In the embodiment, a circuit board is taken as an example of the control assembly 32 and the control assembly 32 controls the heating assembly 3 to heat the turbulence thermal conduction element 31. The heating assembly 3 comprises a metallic heating plate that converts electrical energy into thermal energy. When a user attempts to fire the toy gun 5, the pressurized fluid contained in the liquid storage space 41 is conducted through the liquid channel 4 into the turbulence thermal conduction element 31, so that a contact surface area of the turbulence thermal conduction element 31 with the pressurized fluid is increased to allow the pressurized fluid to absorb thermal energy and thus improve efficiency of gasification of the pressurized fluid whereby the pressurized fluid is converted into gas before reaching the terminal end of the liquid channel 4, making the heating efficiency of the turbulence thermal conduction element 31 even higher and gasification of the pressurized fluid more complete. The gas for formed through gasification is discharged through the gas discharge section 12 of the magazine body 1 so as to get out of the magazine body 1. The gas, when entering the toy gun 5, drives a bullet loaded in the toy gun 5 to perform a shooting operation of the bullet. Further, the turbulence thermal conduction element 31 is provided with the temperature detection element 33. The temperature detection element 33 can be a thermometer so that the temperature detection element 33 detects a temperature of the turbulence thermal conduction element 31. The temperature detection element 33 is electrically connected with the control assembly 32 so that when the turbulence thermal conduction element 31 is continuously heated by the heating assembly 3 to have the temperature the turbulence thermal conduction element 31 excessively high, the control assembly 32 cuts off connection between the heating assembly 3 and the electricity supply device 2 to stop the heating assembly 3 from further heating the turbulence thermal conduction element 31. However, after the toy gun 5 has been operated for multiple successive shots that makes the temperature of the magazine body 1 excessively low, the control assembly 32 re-establishes the connection between the heating assembly 3 and the electricity supply device 2 to allow the heating assembly 3 to resume heating of the turbulence thermal conduction element 31 so as to set the magazine body 1 at an optimum environmental operation temperature. Further, the thermal isolation section 11 provided on the magazine body 1 is made of a plastic material that helps isolate the thermal energy inside the magazine body 1 and prevents the thermal energy from transmitting to the outside thereby preventing a user from being burnt by an excessively high temperature of the toy gun 5 and achieving an effect of saving energy.

The above provides an example of the present invention and is not intended to limit the scope of the present invention as defined in the appended claims. Easy modification and equivalent structural variation based on the contents of the specification and drawings of the present invention are considered falling within the scope of the present invention as defined in the appended claims.

Thus, with reference being had to all the drawings, the present invention, as compared to the prior art, demonstrates the following advantages when put into practice:

(1) The arrangement of the electricity supply device 2 and the heating assembly 3 enable direct heating to be carried out inside the magazine body 1 to set the magazine body 1 at an optimum environmental operation temperature and the efficiency of heating is made higher to thereby achieve an effect of saving energy.

(2) The arrangement of the turbulence thermal conduction element 31 helps increase a contact surface area of pressurized fluid and the turbulence thermal conduction element 31 so that gasification of the pressurized fluid is made more efficient and more complete.

(3) The arrangement of the thermal isolation section 11 helps isolate thermal energy to protect a user from burning and provide an effect of saving energy.

(4) The arrangement of the turbulence thermal conduction element 31 at a terminal end of the liquid channel 4 makes the efficiency of heating of the turbulence thermal conduction element 31 even better.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A magazine gas heating structure, comprising:

a magazine body;

at least one electricity supply device arranged in the magazine body;

at least one heating assembly arranged in the magazine body and electrically connected with the electricity supply device;

at least one liquid channel formed in the magazine body; and at least one turbulence thermal conduction element arranged in the magazine body and connected to the heating assembly, the turbulence thermal conduction element being arranged at a terminal end of the liquid channel;

wherein the heating assembly is provided with at least one control assembly; and wherein the turbulence thermal conduction element is provided with at least one temperature detection element electrically connected with the control assembly.

2. The magazine gas heating structure according to claim 1, wherein the electricity supply device comprises at least one electricity supply element and at least one electrical conduction element electrically connected with the electricity supply element, the electrical conduction element being selectively and electrically connected with the control assembly.

3. The magazine gas heating structure according to claim 2, wherein the electricity supply element comprises a battery.

4. The magazine gas heating structure according to claim 1, wherein the magazine body comprises at least one thermal isolation section.

5. The magazine gas heating structure according to claim 4, wherein the thermal isolation section is made of a plastic material.

6. The magazine gas heating structure according to claim 1, wherein the magazine body is formed therein with at least one liquid storage space in communication with the liquid channel.

7. The b magazine gas heating structure according to claim 1, wherein the magazine body comprises at least one gas discharge section formed therein.

* * * * *